US005333563A

United States Patent [19]

Yamanoi

[11] Patent Number: 5,333,563

[45] Date of Patent: Aug. 2, 1994

[54] SEWING METHOD AND APPARATUS

[76] Inventor: Yoshiaki Yamanoi, 25-1-805, Shinjuku 1-Chome, Shinjuku-ku, Tokyo, Japan

[21] Appl. No.: 835,445

[22] PCT Filed: Jul. 5, 1991

[86] PCT No.: PCT/JP91/00906

§ 371 Date: Feb. 27, 1992

§ 102(e) Date: Feb. 27, 1992

[87] PCT Pub. No.: WO92/01106

PCT Pub. Date: Jan. 23, 1992

[30] Foreign Application Priority Data

Jul. 6, 1990 [JP] Japan ..... 2-177391
Jul. 3, 1991 [JP] Japan ..... 3-162981

[51] Int. Cl.[5] ..... D05B 35/00; D05B 39/00

[52] U.S. Cl. ..... 112/262.3; 112/104; 112/147

[58] Field of Search ..... 112/262.1, 262.3, 265.1, 112/121.12, 121.15, 141, 147, 104, 113, 114, 65, 68, 70, 423, 424, 428

[56] References Cited

U.S. PATENT DOCUMENTS 2,176,643 10/1939 Sigoda ..... 112/424 X
3,277,853 10/1966 Tucci ..... 112/147
4,463,697 8/1984 Vogt et al. ..... 112/147 X
5,092,258 3/1992 Goldbeck et al. ..... 112/104 X

FOREIGN PATENT DOCUMENTS 59-119278 8/1984 Japan .
60-7663 3/1985 Japan .
62-38193 2/1987 Japan ..... 112/70
63-37179 3/1988 Japan ..... 112/70

*Primary Examiner*—Peter Nerbun
*Attorney, Agent, or Firm*—Larson and Taylor

[57] ABSTRACT

The present invention relates to a method of and an apparatus for finishing pipings or a box pocket portion and face portion neighbouring therewith in a flat form irrespective of the thickness of fabrics to be used in stitching the pipings or box pockets. The method is constituted in such a manner that two seam lines (3 and 6) come as close as possible and folding is made so that the same superimposition is created at both sides of the seam lines (3 and 6) i.e. in an edge forming part and its neighbouring face cloth portion. The apparatus is constructed such that one or more base cloth material supporting members (20) and one or more patch cloth holding and folding guide mechanisms (21) are laterally displaceable in synchronization.

6 Claims, 3 Drawing Sheets

SEWING METHOD AND APPARATUS

TECHNICAL FIELD

The present invention relates to a sewing method and apparatus usable for making box pockets or pipings in sewing work.

BACKGROUND ART

Conventionally various kinds of sewing methods and means have been proposed for stitching the box pockets or pipings. For example, Japanese Utility Model Kokai No. 56-9383 discloses a stitched product manufactured such that a patch cloth and a core material are retained being superimposed on a base cloth material, ends of the respective superimposed base cloth material, patch cloth and core material are stitched together to form a seam line, the patch cloth and the core material are folded along the seam line over to the opposite side of the seam line, the free end of the patch cloth is folded to the rear side of the patch cloth so as to enclose the core material, and the patch cloth thus superimposed with the rear side thereof is stitched with the patch cloth in parallel with said seam line.

Similarly, Japanese Utility Model Kokai No. 55-101580 discloses means in which a patch cloth is press supported by movable holding means upon a base cloth material placed on a sewing machine table, the base cloth/material and the patch cloth are stitched in parallel keeping a space by using two sewing needles while moving the movable holding means in a fabric feeding direction, and the base cloth material and the patch cloth between two seam lines are cut to provide a piped stitching.

As an example that teaches the similar means there can be mentioned Japanese U.M. Kokai No. 57-140268.

However, according to the piping stitching or box pocket stitching so far proposed the piping portion and its neighboring face portion of base cloth material usually vary in the number of superimposing sheets of the cloths or the like, and therefore stepped folds are created between the piping portion and its neighboring face cloth portion. Excepting a specific case such stepped folds in the piping portion have been shunned because of poor quality or undesirable finishing around a pocket. On the other hand, the piping portion with such stepped folds is likely to create a flap or creases while wearing the garment thereby presenting a problem of lowering the valuation of a suit itself.

It is therefore a first object of the present invention to overcome such a problem which occurs in stitching pipings or box pockets and to provide an improved sewing method where the piping portion and its neighboring face cloth portion are finished flat.

A second object of the present invention is to provide an apparatus for carrying out said sewing method.

DISCLOSURE OF THE INVENTION

To achieve the first object, according to a first aspect of the present invention there is provided a sewing method characterized in that a patch cloth is pressed against a base cloth material, the patch cloth and the base cloth material are stitched along one edge portion of the patch cloth to form a first seam line while keeping a space approximately equal to the width of a piping to be formed away from the one edge portion of the patch cloth, said one edge portion of the patch cloth is folded toward the other edge portion thereof based on the first seam line as a folding axis, which is formed by said stitching, the other edge portion of the patch cloth is folded over said one edge portion thereof along said one edge portion of the folded patch cloth, the other edge portion of the folded patch cloth and the base cloth material are stitched together in parallel along said first seam line at a region close to the first seam line to allow a second seam line to be formed, and the portion of the base cloth material, which is positioned in the opposite side of the second seam line to the first seam line, is folded crossing over the second seam line along the first seam line whereby the base cloth material and the patch cloth are triply superimposed at both the sides of said first and second seam lines.

Further, according to a second aspect of the invention there is provided a sewing method characterized in that two sheets of a patch cloth are disposed in parallel on a base cloth material, each sheet of said patch cloth is stitched over said base cloth material along one edge portion of each patch cloth so as to form a first seam line while keeping a space approximately equal to the width of a piping to be formed away from said one edge portion of each patch cloth, said one edge portion of each patch cloth is folded toward the other edge portion thereof based on the first seam line as a folding axis, which is formed by said stitching, the other edge portion of each patch cloth is folded over said one edge portion thereof along said one edge portion of each of the two folded patch cloth sheets, the other edge portion of each folded patch cloth and the base cloth material are stitched together in parallel along said first associated seam line at a region close to the first seam line to allow a second seam line to be formed, and the portion of the base cloth material, which is positioned in the opposite side of the second associated seam line to the first seam line, is folded over the second seam line along each of the first seam lines whereby the base cloth material and each of the two patch cloth sheets are triply superimposed at the both the sides of two pairs of the first and second seam lines being close to each other.

In the first and second aspects of the invention, it is preferable that the space between the first and second seam lines may be set to about 0.5 mm.

Furthermore, the second object of the present invention is achieved by providing a sewing apparatus according to a third aspect of the invention, characterized in that it comprises at least one base cloth material supporting member which is laterally displaceable between a first operational position where a first stitching region of a base cloth material and a patch cloth is aligned with a sewing needle and a second operational position where a second stitching region close to and in parallel with the first stitching region is aligned with the sewing needle and a guide mechanism for holding and folding the patch cloth, which is vertically movable to the upper surface of said base cloth material supporting member and laterally displaceable in synchronization with said supporting member, and said guide mechanism includes at least one patch cloth holding and folding guide member which extends along the axial direction of the base cloth material supporting member and which press holds the base cloth material in cooperation with the supporting member, a second patch cloth holding and folding guide member which is arranged in parallel with and keeping a space away from said guide member and which press holds the base cloth material and the patch cloth in cooperation with the base cloth material supporting member, and a holding arm member which presses from the upper side the base cloth material and the patch cloth along the stitching region thereof.

In the present sewing apparatus, according to a preferred embodiment there may be provided a pair of the base cloth material supporting members in such a way that they are mutually displaced laterally and reversely between the mutually approaching first operational positions and mutually separated second operational positions, and each of the base cloth material supporting members can be combined with the patch cloth holding and folding guide mechanism.

Further, preferably, each first patch cloth holding and folding guide member can be provided with a protrusion body which protrudes toward the second associated patch cloth holding and folding guide member for folding one edge portion of the patch cloth toward the other edge portion thereof along the first stitching region, and each second patch cloth holding and folding guide member may be provided with a folding guide element which protrudes toward the first associated patch cloth holding and folding guide member for folding the other edge portion of the folded patch cloth over one edge portion thereof along it.

In each method of the present invention thus constituted, the edge or piping forming part is constituted by a triply folded patch cloth, and the face cloth portion in the neighborhood of the edge forming part results to be constituted by a triple body of the patch cloth and base cloth material doubly folded along the first seam line. Moreover, since the distance between the seam line of the edge forming part and the seam line of the triple body constituting the face cloth portion neighboring with the edge forming part is short it is possible to form the edge forming part and the face cloth portion neighboring with said part, in a continuous flat form substantially without accompanying stepped folds or creases.

Further, according to the method of the second aspect of the invention, two sheets of the patch cloth may be placed in parallel upon a single base cloth material to permit two-line edge forming parts to be simultaneously formed, so that the sewing working can be efficiently carried out.

Furthermore, with the apparatus according to the third aspect of the invention, by coupling each base cloth material supporting member with the associated patch cloth holding and folding guide mechanism, each base cloth material and each patch cloth can be accurately guided to and positioned at the two mutually approaching stitching positions, and at the same time desired bending and folding can be effected.

PREFERRED FORMS BY WHICH THE INVENTION IS TO BE EXECUTED

The present invention will now be described with reference to the accompanied drawings.

Figure 1:
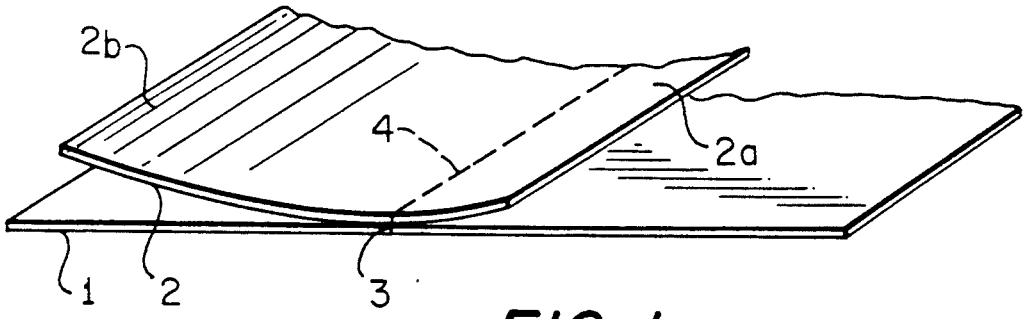
FIG. 1 is a schematic perspective view showing the first sewing step in one embodiment of the present invention.

FIGS. 1 to 5 schematically show, according to a first embodiment of the present invention, a sewing method suitable for forming box pockets or pipings. In the illustrated embodiment, as shown in FIG. 1, on a base cloth material 1 which is to be a face cloth, there is pressed a patch 2 for forming the edges or pipings of the box pockets, and then base cloth material 1 and the patch cloth 2 are stitched by a sewing machine in parallel along an edge portion 2*a* of the patch cloth 2 at a position 3 away by a distance approximately equal to the width of an edge or piping to be formed from the edge portion 2*a* of the patch cloth 2. At that time, in order that the positional relation between the base cloth material 1 and patch cloth 2 is not varied the material and cloth are fed by suitable means (not shown) in the fabric feeding direction to the needle of the sewing machine while pressing the material and cloth by using a patch cloth holding and folding guide mechanism shown in FIG. 7 which is referred to below.

Figure 2:
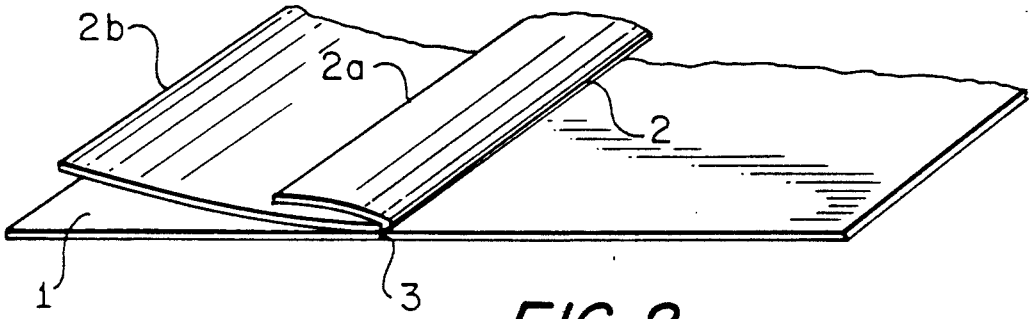
FIG. 2 is a schematic perspective view showing the second sewing step in said one embodiment of the present invention.
Figure 3:
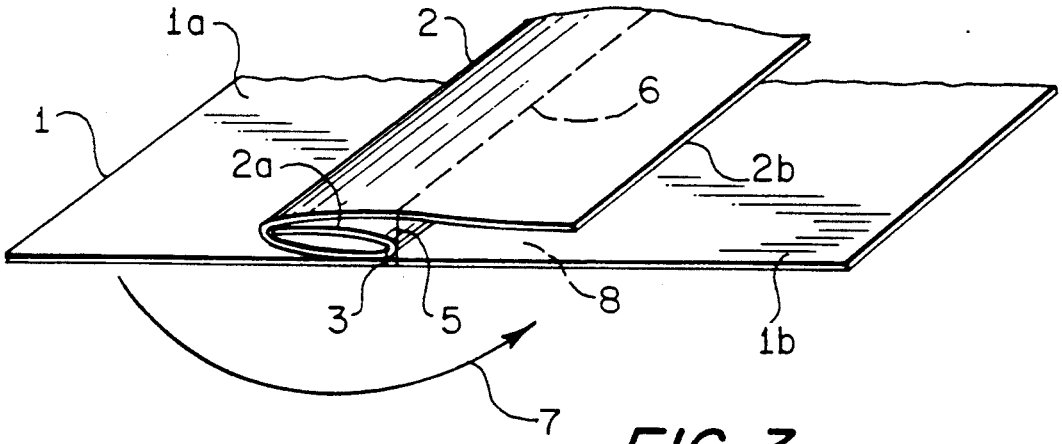
FIG. 3 is a schematic perspective view showing the third sewing step in said one embodiment of the present invention.

Based on a first seam line 4, as a folding axis, which is formed by stitching the base cloth material 1 and the patch cloth 2 in the first step illustrated in FIG. 1, the one edge portion 2*a* of the patch cloth 2 is folded toward the other edge portion 2*b* thereof as shown in FIG. 2. Then, the other edge portion 2*b* is folded over the one edge portion 2*a* as shown in FIG. 3, along said one edge portion 2*a* of the once-folded patch cloth 2. In such case, preferably, each of the edge portions 2*a* and 2*b* of the patch cloth 2 is folded on the base cloth material 1 by using a suitable means, such as a device as shown in FIG. 7, for folding-in, pressing and postioning the material and the patch cloth, said device extending in the material feeding direction laterally to the sewing needle.

Figure 4:
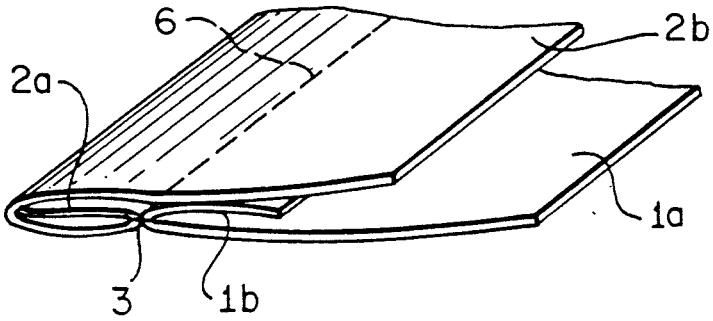
FIG. 4 is a schematic perspective view showing the fourth sewing step in said one embodiment of the present invention.

As illustrated in FIG. 3, at a position 5 (preferably about 0.5 mm away from the position 3 of the first seam line 4 though depending on using fabrics) which is as close as possible to the position 3, the other edge 2*b* of the folded patch cloth 2 and the base cloth material 1 are stitched in parallel along the first seam line 4 thereby forming a second seam line 6. Thereafter, as shown with an arrow 7 in FIG. 3, the portion 1*a* of the base cloth material 1, which is positioned opposite to the second seam line 6 with respect to the first seam line 4, is folded over the second seam line 6 and thus the portion 1*b* of the base cloth material 1 along the first seam line 4, and the portion 1*b* is cut as necessary at a position marked with a dotted line 8 resulting in the form as shown in FIG. 4. The materials thus obtained are press worked as usual by ironing and there is completed a final product as shown turned over in the enlarged view of FIG. 5. As will be seen from FIG. 5, the base cloth material 1 and the patch cloth 2 are triplely overlapped or superimposed at both the sides of the mutually close first and second seam lines 4 and 6, and the face cloth portion of the fabrics has substantially a continuous flat surface.

Figure 6:
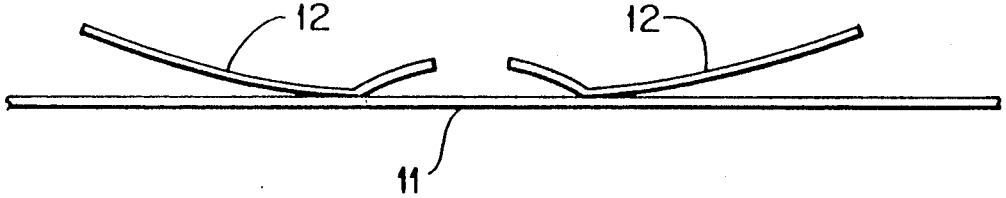
FIG. 6 is a schematic elevation showing a method according to another embodiment of the present invention.
Figure 5:
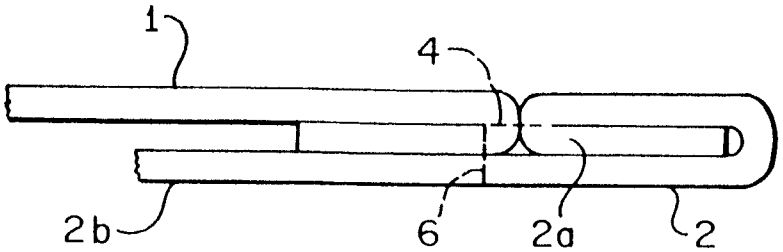
FIG. 5 is an enlarged sectional view of an end product manufactured according to the method shown in FIGS. 1 to 4.

FIG. 6 shows another embodiment of the method of the present invention. In this case, on a single base cloth material 11 two sheets of a patch cloth 12 are disposed, and two box pockets or pipings are simultaneously formed by using a two-line sewing machine. The two sheets of the patch cloth 12 are disposed in parallel in the cloth feeding direction upon the base cloth material 11 while keeping a space, and the stitching and folding steps are taken to the respective patch cloth sheets 12 substantially in the same manner as in the embodiment illustrated in FIGS. 1 to 5 whereby it is possible to simultaneously manufacture two products each having the structure as shown in FIG. 5.

Figure 7:
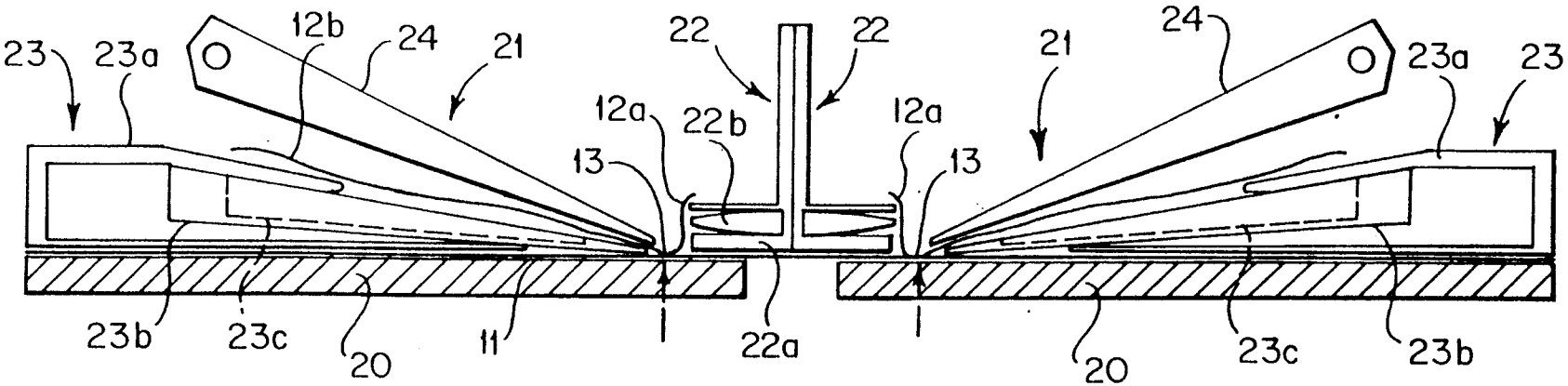
FIG. 7 is a schematic diagram showing the main portions of an example of the apparatus for carrying out the present method.
Figure 8:
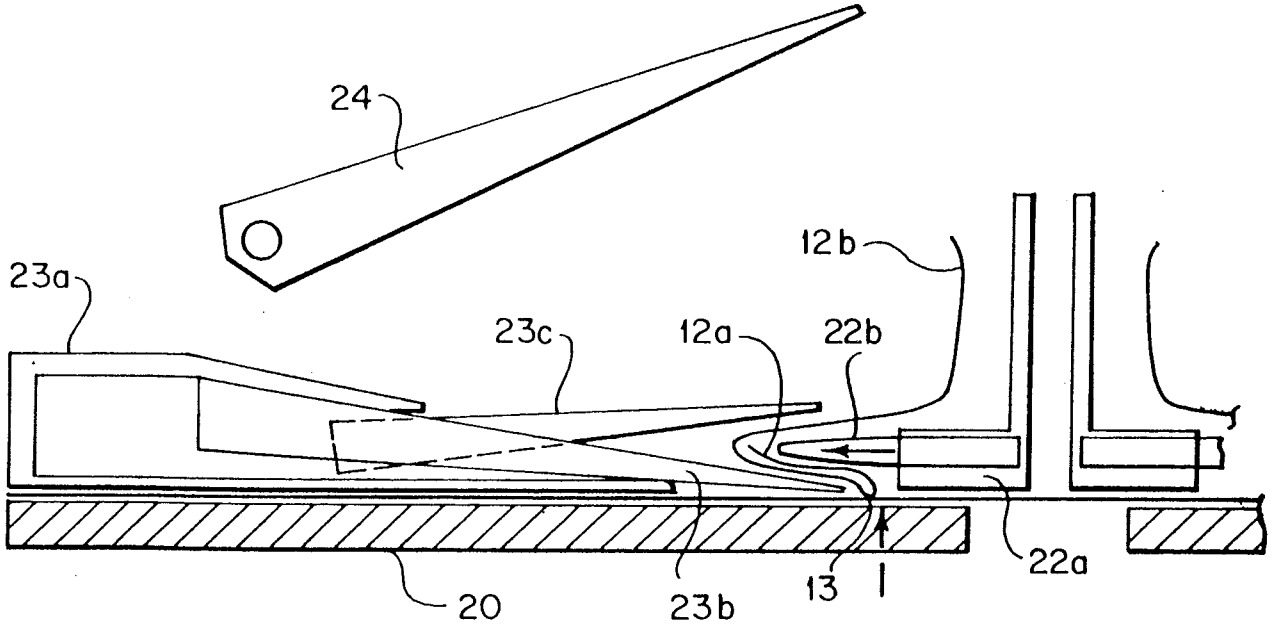
FIG. 8 is an enlarged partial view showing the operation in the folding process in the apparatus shown in FIG. 7.
Figure 9:
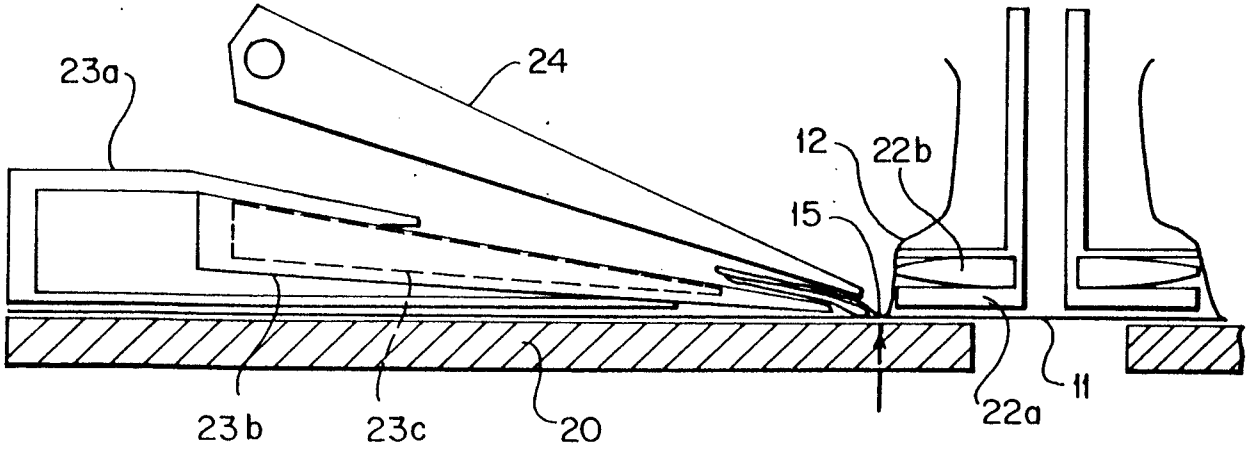
FIG. 9 is an enlarged partial view showing the operation in the second stitching process in the apparatus shown in FIG. 7.

FIGS. 7 to 9 illustrate an example of an apparatus for carrying out the method shown in FIG. 6.

In FIG. 7, reference numeral 20 designates a pair of plate-like base cloth material support members each extending along the fabric feeding direction, and these support members 20 in pairs are disposed so as to be mutually displaced laterally and reversely between a first operational position where a first stitching region 13 of the base cloth material 11 and the patch cloth 12, both in the feeding direction, is aligned with the position (marked with a dotted line arrow in the drawing) of the sewing needle, and a second operational position where a second stitching region 15 close to and parallel with said first stitching region 13 is aligned with the sewing needle.

In such case, the lateral displacement of each of the base cloth material support members 20 may be performed by a proper mechanical drive means such as a cam or spring or drive means utilizing an electromagnetic force or fluid force or by a mechanism combining them. On the other hand, it is possible to construct the apparatus to be able to adjust the space between the first and second operational positions depending on the fabric to be used.

Reference 21 designates a patch cloth holding and folding guide mechanism which is positioned on each support member 20. This mechanism comprises a first patch cloth holding and folding guide member 22 which is located on the inside portion of the support member 20 for receiving the base cloth material 11 and which tightly presses the base cloth material in cooperation with the support member 20, a second patch cloth holding and folding guide member 23 which is located retaining a space away from and in parallel with the first guide member 22 and which tightly presses the base cloth material 11 and the patch cloth 12 in cooperation with the support member 20, and a holding arm member 24 which presses, from the upper side, the base cloth material 11 and the patch cloth 12 along the regions 13 and 15 for stitching with the material 11 and the cloth 12.

Each of the first patch cloth holding and folding guide members 22 includes a patch cloth holding plate 22*a* which presses for holding from the upper side the base cloth material 11 placed on the combined base cloth material support members 20 and which extends in the fabric feeding direction, and a protrusion body 22*b* also extending in the fabric feeding direction, which projects laterally and outwardly after the stitching of the first stitching region 13 and which along the seam line folds one side edge 12*a* of the patch cloth 12 crossing over the other side edge 12*b* of the patch cloth spreading over the second patch cloth holding and folding guide member 23. The protrusion body 22*b* is driven by means of a proper driving mechanism using a cam mechanism, a fluid force, an electromagnetic force or the like.

Before the stitching of the first stitching region 13, when the respective base cloth material receiving members 20 and the respective patch cloth holding and folding guide mechanisms 21 travel to the first operational position, the respective first patch cloth holding and folding guide members 22 can be lifted upward from the base cloth material 11. Owing to such an operation, as shown in the drawing, the base cloth material 11 can be easily loosened beneath the patch cloth holding and folding guide member 22 without falling down into the clearance between the support members 20.

On the other hand, each of the second patch cloth holding and folding guide members 23 includes a holding frame 23*a* extending in the fabric feeding direction, which presses for holding from the upper side the base cloth material 11 placed on the combined support members 20, a plate-like pressing body 23*b* which is mounted within the holding frame 23*a* and which press supports, on the combined support members 20, the base cloth material 11 along the position always being close to the stitching region of the base cloth material 11, and a plate-like folding guide element 23*c*. This guide element 23*c* is such one that it is positioned on the plate-like pressing body 23*b*, it rises up when the projection 22*b* of the first patch cloth holding and folding guide member 22 projects (FIG. 8) thereby forming a clearance with the plate-like folding pressing body 23*b* for the entry of the projection body 22*b* thereinto, and thereafter, the fabrics travel toward the first patch cloth holding and folding guide member 22 in pair whereby the other edge 12*b* of the patch cloth 12 is folded over one edge 12*a* thereof along this one edge 12*a* of the patch cloth 12 folded by the operation of the projection body 22*b* of the first patch cloth holding and folding guide member 22.

In the example shown in the drawing, the plate-like folding pressing body 23*b* and the plate-like folding guide element 23*c* are constructed in a mutually meshing comb-like form.

Further, the holding arm member 24 is movably supported above the second patch cloth holding and folding guide member 23, and the end thereof acts so that as shown in the drawing, when the base cloth material 11 and the patch cloth 12 are stitched the base cloth material 11 and the patch cloth 12 may be pressed from the above at a position close to the respective stitching regions 13 and 15 of the base cloth material and the patch cloth.

It is necessary to construct each part of each patch cloth holding and folding guide mechanism 21 in such a manner that it can be displaced laterally in syncronization with the combined base cloth material receiving member 20. For example, the construction may be such that said each part is driven by a common laterally-sliding mechanism.

In the apparatus illustrated in the drawing it should be understood that the respective parts of the patch cloth holding and folding guide mechanisms 21 should not be limited to the arrangements illustrated in the drawing in any way, and any alteration may be made. For example, in the drawing the plate-like pressing body 23*b* and plate-like folding guide element 23*c* of the second patch cloth holding and folding guide member 23 are constructed in a mutually meshing comb-like form, however, they also may be constructed in a superimposing flat plate shape. Further, though the patch cloth holding and folding guide mechanisms 21 are constructed in pairs in the illustrated embodiment it is naturally possible to construct the mechanism by a single unit in order to apply it to the method shown in FIGS. 1 to 5.

Furthermore, though in the apparatus illustrated in FIGS. 7 to 9 it is illustrated in such a manner that the base cloth material 11 is suspended into the clearance between the base cloth material support members 20 when each of them and the patch cloth holding and folding guide mechanisms 21 moves to the first operational position shown in FIG. 7, it is naturally possible either to provide a suitable recess or to form a notch at the bottom of the patch cloth holding plate 22*a* in the first patch cloth holding and folding guide member 22 to allow the base cloth material 11 to be loosened upwardly in the recess or notch.

Moreover, the apparatus illustrated in the drawing is provided with a pair of the movable patch cloth holding and folding guide members 22, but a single patch cloth holding and folding guide member may be provided in construction at each of the two sides thereof with laterally slidable patch cloth holding and folding guide means.

INDUSTRIAL APPLICABILITY

As mentioned above in detail, according to the method of the present invention, two seam lines are brought as close as possible, and folding is made so that the superimposition of the fabrics may be aligned in both the sides of the seam lines i.e. in the edge forming portion and its neighboring face cloth portion. Therefore, the product can be finished uniformly flat without creating stepped folds between the edge forming portion and its neighboring face cloth portion thereby to provide a very useful method for forming box pockets or pipings for men's or women's quality garment.

On the other hand, according to the method of the second aspect of the invention, two products can be manufactured at the same time so that besides the abovementioned advantage it is capable of expecting such advantages as an efficient sewing working, improved productivity and reduced cost.

Furthermore, according to the apparatus of the present invention, since the base cloth material support member and the patch cloth holding and folding guide mechanism are constructed to be laterally displacable in synchronization it is possible to automatically and accurately position the two mutually neighboring seam lines to be formed, to the needles of the sewing machine. Thus by combination of the present apparatus with a sewing machine it is possible to improve the finishing state of box pockets or pipings and to make the forming working rapidly efficient.

I claim:

1. A sewing method comprising the steps of pressing a patch cloth against a base cloth material, stitching said patch cloth over said base cloth material along one edge portion of the patch cloth so as to form a first seam line while maintaining along said one edge portion a space approximately equal to the width of a piping to be formed, said space being located between said first seam line and the outer edge of said one edge portion, folding said one edge portion of the patch cloth toward the opposite edge portion thereof along the first seam line as a folding axis, folding the opposite edge portion of the patch cloth over said one edge portion along said outer edge of the folded patch cloth as a folding axis, stitching the opposite edge portion of folded patch cloth and the base cloth material together at a region close to and parallel to the first seam line to form a second seam line, and folding the portion of the base cloth material, which is positioned on a side of said first seam line which is opposite to the side of said first seam line on which the second seam line is located, over the second seam line along the first seam line as a folding axis whereby the base cloth material and the patch cloth are triply superimposed at both sides of said first and second seam lines.

2. A sewing method as claimed in claim 1, wherein said space between the first and second seam lines is about 0.5 mm.

3. A sewing method comprising the steps of pressing a patch cloth against a base cloth material, stitching said patch cloth over said base cloth material along one edge portion of the patch cloth so as to form a first seam line while maintaining along said one edge portion a space approximately equal to the width of a piping to be formed, said space being located between said first seam line and the outer edge of said one edge portion, folding said one edge portion of the patch cloth toward the opposite edge portion thereof along the first seam line as a folding axis, folding the opposite edge portion of the patch cloth over said one edge portion along said outer edge of each of the two folded patch cloths as a folding axis, stitching the opposite edge portion of each folded patch cloth and the base cloth material together at a region close to and parallel to a respective first seam line to form a second seam line associated with a respective first seam line, thus forming two pairs of first and second seam lines, and folding the portion of the base cloth material, which is positioned on a side of a first seam line which is opposite to the side of said first seam line on which the second associated seam line is located, over the second seam line along each of the first seam lines as a folding axis whereby the base cloth material and each of the two patch cloth sheets are triply superimposed at both sides of said two pairs of the first and second seam lines.

4. A sewing method as claimed in claim 3, wherein said space between the first and second seam lines is set to about 0.5 mm.

5. A sewing apparatus comprising a pair of base cloth material supporting members, each of said supporting members being laterally displaceable between a first operational position where a first stitching region of a base cloth material and a patch cloth are aligned with a sewing needle and a second operational position where a second stitching region close to and parallel with the first stitching region is aligned with the sewing needle, and a guide mechanism for holding and folding a patch cloth, said guide mechanism being vertically movable to the upper surface of said base cloth material supporting members and laterally displaceable in synchronization with said supporting members, said guide mechanism including a first patch cloth holding and folding guide member which extends along the axial direction of the base cloth material supporting members and which press holds a base cloth material in cooperation with one of the supporting members, a second patch cloth holding and folding guide member which is arranged in parallel with and spaced away from said first patch cloth holding and folding guide member and which press holds a base cloth material and a patch cloth in cooperation with the other of said base cloth material supporting members, and a holding arm member which presses from the upper side a base cloth material and a patch cloth along the stitching region thereof, said pair of base cloth material supporting members being mutually displaceable laterally and reversely between mutually approaching first operational positions and mutually separated second operational positions, and each of the base cloth material supporting members being combined with said patch cloth holding and folding guide mechanism.

6. A sewing apparatus comprising at least one base cloth material supporting member which is laterally displaceable between a first operational position where a first stitching region of a base cloth material and a patch cloth is aligned with a sewing needle and a second operational position where a second stitching region close to and in parallel with the first stitching region is aligned with the sewing needle, and a guide mechanism for holding and folding the patch cloth, said guide mechanism being vertically movable to the upper surface of said base cloth material supporting member and laterally displaceable in synchronization with said at least one base cloth material supporting member, said guide mechanism including a first patch cloth holding and folding guide member which extends along the axial direction of the said at least one base cloth material supporting member and which press holds the base cloth material in cooperation with the supporting member, a second patch cloth holding and folding guide member which is arranged in parallel with and spaced away from said first patch cloth holding and folding guide member and which press holds the base cloth material and the patch cloth in cooperation with said at least one base cloth material supporting member, and a holding arm member which presses from the upper side the base cloth material and the patch cloth along the stitching regions thereof, each of said first patch cloth holding and folding guide members being provided with a protrusion body which protrudes toward the second associated patch cloth holding and folding guide member for folding one edge portion of the patch cloth toward the other edge portion thereof along the first stitching region, and said each second patch cloth holding and folding guide members being provided with a folding guide element which protrudes toward the first associated patch cloth holding and folding guide member for folding the other edge portion of the folded patch cloth over one edge portion thereof along said one edge portion.

* * * * *